US007448156B2

(12) United States Patent
Tucich

(10) Patent No.: US 7,448,156 B2
(45) Date of Patent: Nov. 11, 2008

(54) FIREARM WALL LOCK

(76) Inventor: Jonathan Tucich, 4645 Woodworth, Dearborn, MI (US) 48228

( * ) Notice: Subject to any disclaimer, the term of this patent is extended or adjusted under 35 U.S.C. 154(b) by 183 days.

(21) Appl. No.: 11/162,673

(22) Filed: Sep. 19, 2005

(65) Prior Publication Data

US 2006/0060727 A1 Mar. 23, 2006

Related U.S. Application Data

(60) Provisional application No. 60/611,994, filed on Sep. 22, 2004.

(51) Int. Cl.
*F41A 17/00* (2006.01)
*E05B 73/00* (2006.01)
*B60R 7/14* (2006.01)

(52) U.S. Cl. ..... 42/70.11; 70/58; 211/64

(58) Field of Classification Search ..... 42/70.01, 42/70.11; 70/14, 18, 58; 211/4, 8, 64
See application file for complete search history.

(56) References Cited

U.S. PATENT DOCUMENTS 4,936,038 A * 6/1990 Johnson et al. ..... 42/106
5,138,786 A * 8/1992 Fischer ..... 42/70.11
5,282,539 A * 2/1994 Saathoff ..... 211/64
5,287,972 A * 2/1994 Saathoff ..... 211/64
5,520,291 A 5/1996 Graham
5,524,772 A 6/1996 Simmons
5,621,996 A * 4/1997 Mowl, Jr. ..... 42/70.07
6,129,252 A 10/2000 Jackson et al.
6,142,313 A * 11/2000 Young ..... 211/4
6,302,052 B1 10/2001 Sauerwein
6,330,815 B1 * 12/2001 Duncan ..... 70/58
6,427,497 B1 8/2002 Mossberg, Jr. et al.
6,438,885 B1 * 8/2002 Murray et al. ..... 42/70.07
6,530,607 B1 3/2003 Mallis et al.
6,568,116 B2 * 5/2003 Hathaway ..... 42/70.11
6,845,640 B2 * 1/2005 Loeff et al. ..... 70/63
6,986,446 B2 1/2006 Murray et al.

* cited by examiner

*Primary Examiner*—Bret Hayes
(74) *Attorney, Agent, or Firm*—Barnes & Thornburg LLP

(57) ABSTRACT

A firearm wall lock is a wall-mounted device that allows for quick and easy removal of a firearm when the lock is released. When the firearm is secured within the firearm wall lock, the trigger, breach, and firing mechanism are all enclosed to prevent access to or discharge of the firearm. The firearm wall lock is primarily constructed of four components including a post, a shelf, a locking clasp assembly, and a clamp. A firearm is supported by the shelf and is positioned parallel to the post. The clamp holds the top of the firearm barrel in place and the locking clasp assembly encircles and secures the trigger, breach and firing mechanism of the firearm. The firearm wall lock is mounted on the outside surface of a wall, bolted securely to a wall stud, or mounted within a wall between two wall studs.

24 Claims, 7 Drawing Sheets

FIREARM WALL LOCK

RELATED APPLICATIONS

This application claims benefit to U.S. Provisional Application No. 60/611,994 filed Sep. 22, 2004, the disclosure of which is hereby incorporated by reference in its entirety.

BACKGROUND

This disclosure relates to a firearm wall lock that is a wall mounted locking device that securely mounts a long barreled firearm, such as a rifle or a shotgun to the wall. The firearm wall lock allows for quick and easy removal of the firearm when the lock is released. If the need arises to obtain the firearm swiftly, the firearm wall lock can be quickly unlocked and the firearm retrieved. When the firearm is secured to the firearm wall lock, the trigger, breach, and firing mechanism are enclosed to prevent unintentional discharge of the firearm.

By way of background but not limitation, wall mount gun racks typically are used to permit the mounting of a long barrel firearm to a wall. The wall mount gun rack includes a backing plate that is secured to the wall. Extending outward from the backing plate is a pair of horizontal support members that are used to support the stock and barrel of the long barrel firearm. In order to prevent the firearm from being unintentionally discharged, a secondary mechanism, such as a gunlock, must be employed to prevent the mechanism from being actuated. Typically gunlocks are multi-piece units that require several steps for their removal. Even when in use, gunlocks do not prevent individuals from having access to other components of the gun, such as the breach and firing mechanism. In order to prevent access to the breach and firing mechanism, the firearm owner is required to use a gun safe, which inhibits quick removal in the event that the firearm is needed.

In view of the above, it should be appreciated that there is a need for a firearm wall lock that prevents unpermitted access to the trigger, breach and firing mechanism, while permitting quick removal of the firearm from the rack when needed. The present disclosure satisfies these and other needs and provides further related advantages.

The firearm wall lock is a wall-mounted locking device intended to securely mount a long barreled firearm (e.g. shotgun or rifle). The firearm wall lock allows for quick and easy removal of the firearm when the lock is released. If the need arises to obtain the firearm swiftly, the firearm wall lock can be quickly unlocked and the firearm retrieved. When the firearm is secured within the firearm wall lock, the trigger, breach, and firing mechanism are all enclosed to prevent access to or discharge of the firearm. The firearm wall lock is comprised of four primary components that include a post, a shelf, a locking clasp assembly, and a clamp. The firearm is supported by the shelf and is positioned parallel to the post. The clamp holds the top of the firearm barrel in place and the locking clasp assembly encircles and secures the firearm. The basic firearm wall lock is mounted on the outside surface of a wall, bolted securely to a wall stud.

The use of additional components in combination with the firearm wall lock permits the wall lock to be mounted between two wall studs to conceal the firearm within a wall. The additional components include mounting brackets and front panel assembly. The front panel assembly is attached to the mounting brackets. The front panel of the firearm wall lock includes a hinge and a cabinet lock near the bottom of the front panel to create an enclosure. The enclosure allows the firearm wall lock and the firearm to be concealed within a wall.

Other features and advantages of the disclosure will be set forth in part in the description which follows and the accompanying drawings, wherein the embodiments of the disclosure are described and shown, and in part will become apparent upon examination of the following detailed description taken in conjunction with the accompanying drawings.

DETAILED DESCRIPTION

Figure 9:
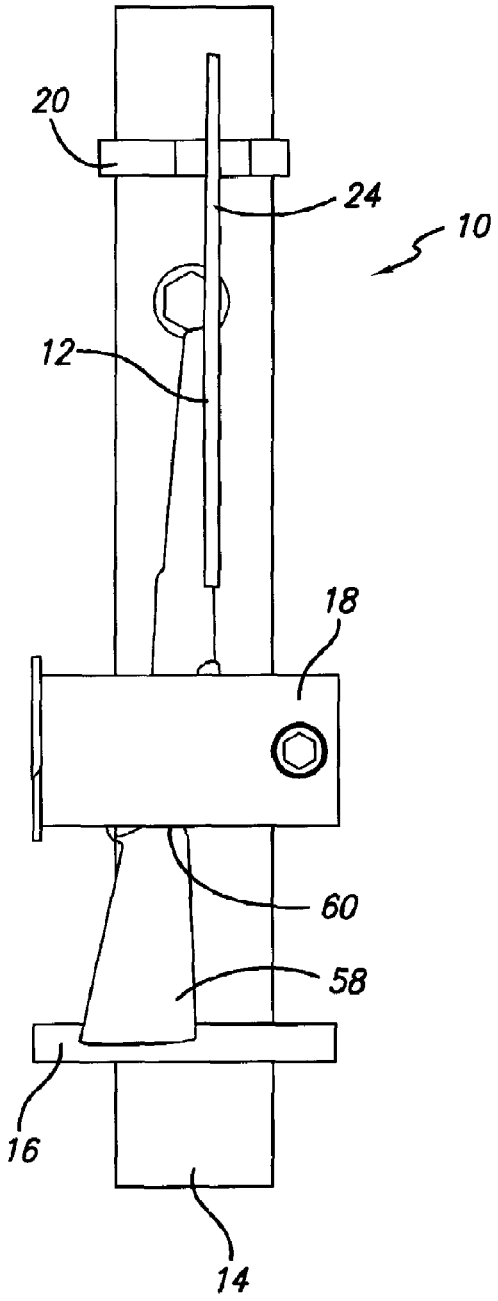
FIG. 9 is a front elevational view of the firearm wall lock equipped with a firearm.
Figure 10:
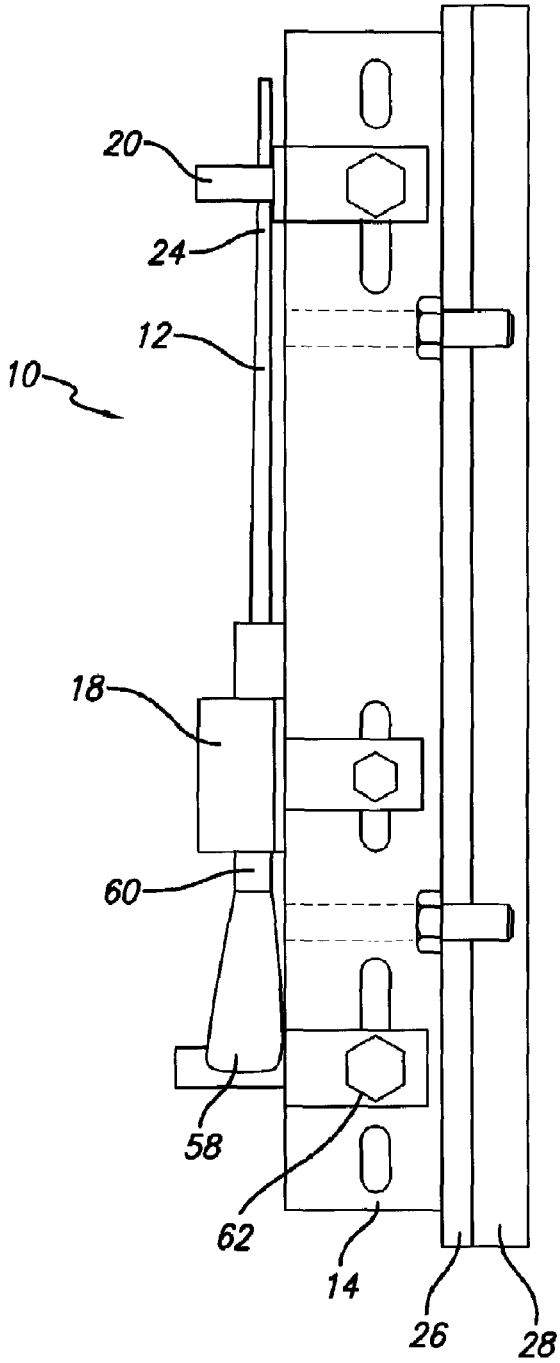
FIG. 10 is a side elevational view of the firearm wall lock equipped with a firearm.

As illustrated in the drawings, a firearm wall lock 10 is adapted to securely mount a long barreled firearm 12 (e.g. shotgun or rifle) to a wall, as illustrated in FIGS. 9 and 10. The firearm wall lock 10 allows for quick and easy removal of the firearm when the lock is released. If the need arises to obtain the firearm swiftly, the firearm wall lock 10 can be quickly unlocked and the firearm 12 retrieved. When the firearm 12 is secured within the firearm wall lock 10, the trigger, breach, and firing mechanism of the firearm 12 are all enclosed to prevent access to or discharge of the firearm 12. While a long barreled firearm is shown, the firearm wall lock 10 can be shortened to accommodate other types of shorter barreled firearms including handguns.

Figure 1:
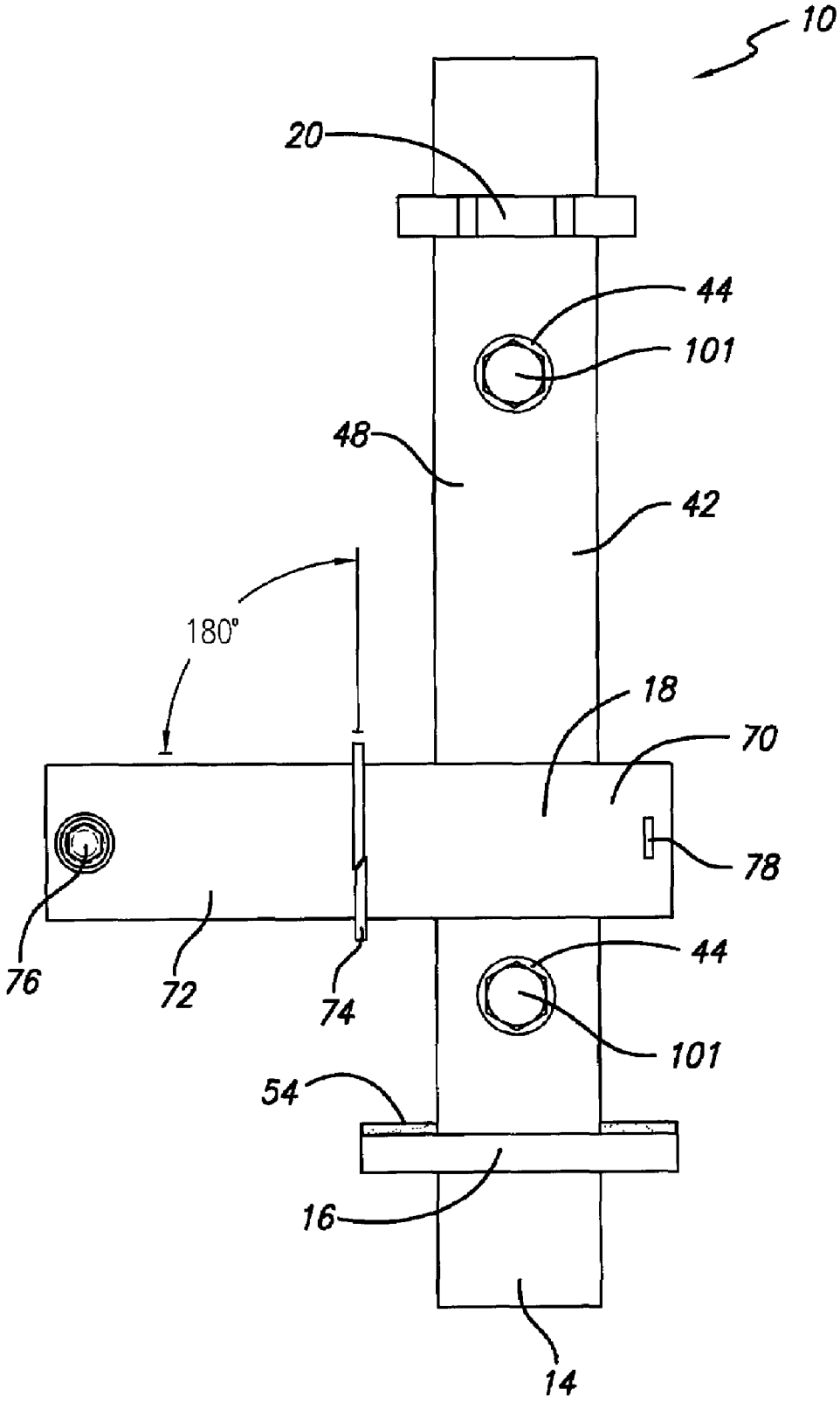
FIG. 1 is a front elevational view of a firearm wall lock.

The firearm wall lock 10 is comprised of four primary components: the post 14, shelf 16, locking clasp assembly 18, and clamp 20 as shown in FIG. 1. The firearm 12 is supported by the shelf 16 and stands parallel to the post 14. The clamp 20 holds the top of the barrel 24 of the firearm 12 in place while the locking clasp assembly 18 encircles and secures the firearm 12. The basic firearm wall lock 10 is mounted on the outside surface of a wall 26, bolted securely to a wall stud 28.

Figure 8:
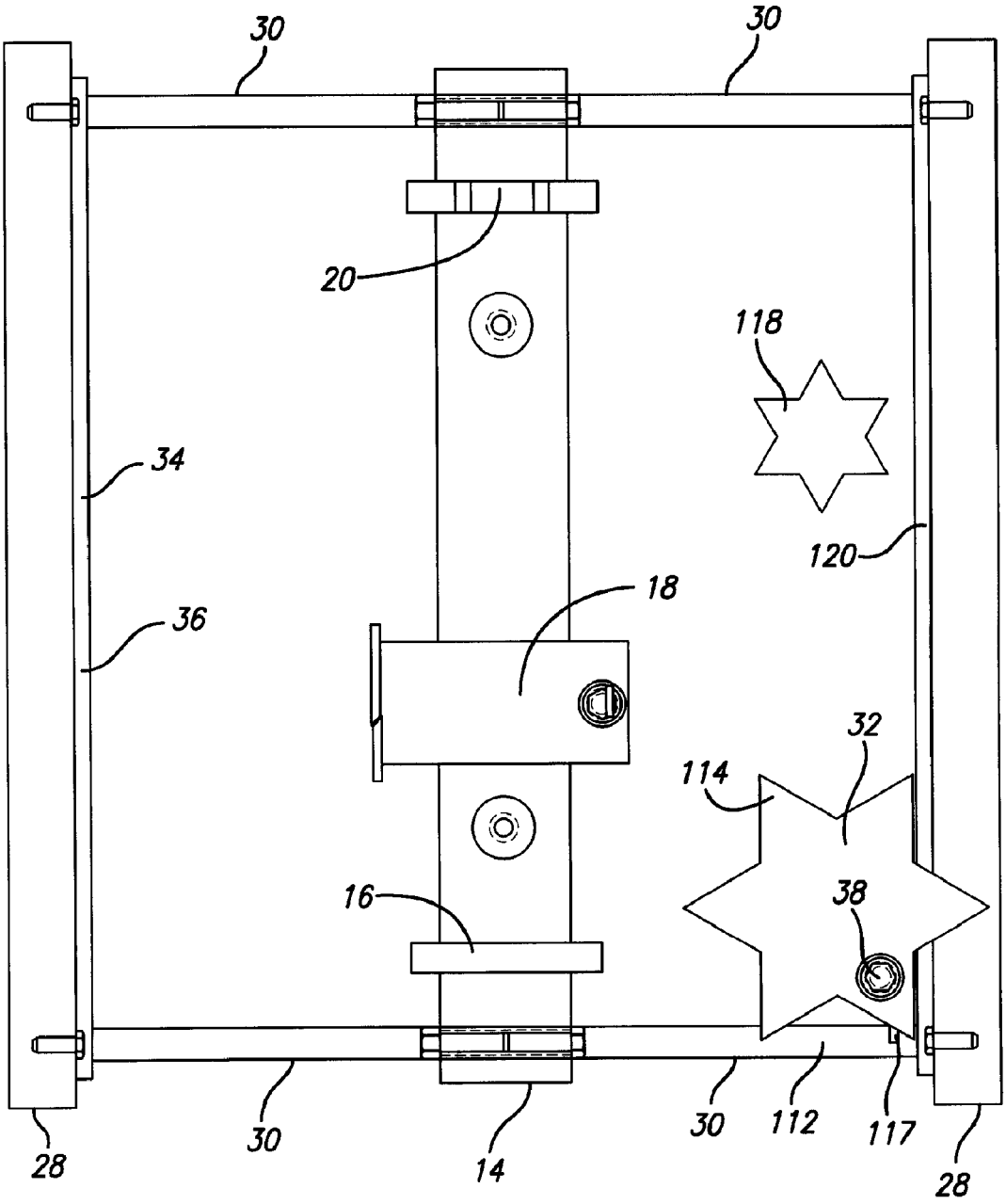
FIG. 8 is a front elevation view of the alternate embodiment of the firearm wall lock illustrating the mounting between wall studs.

The firearm wall lock 10 can also be mounted between two wall studs 28 as shown in FIG. 8. The components that permit the attachment of the firearm wall lock 10 between two studs 28 include mounting brackets 30 and a front panel assembly 32. The front panel assembly 32 of the firearm wall lock 10 includes a hinge 34, bracket 36, and a cabinet lock 38 near the bottom of the front panel assembly 32 that inserts into a mounting bracket 40. The front panel assembly 32 permits the firearm wall lock 10 and the firearm 12 to be concealed within the wall 26.

Figure 7:
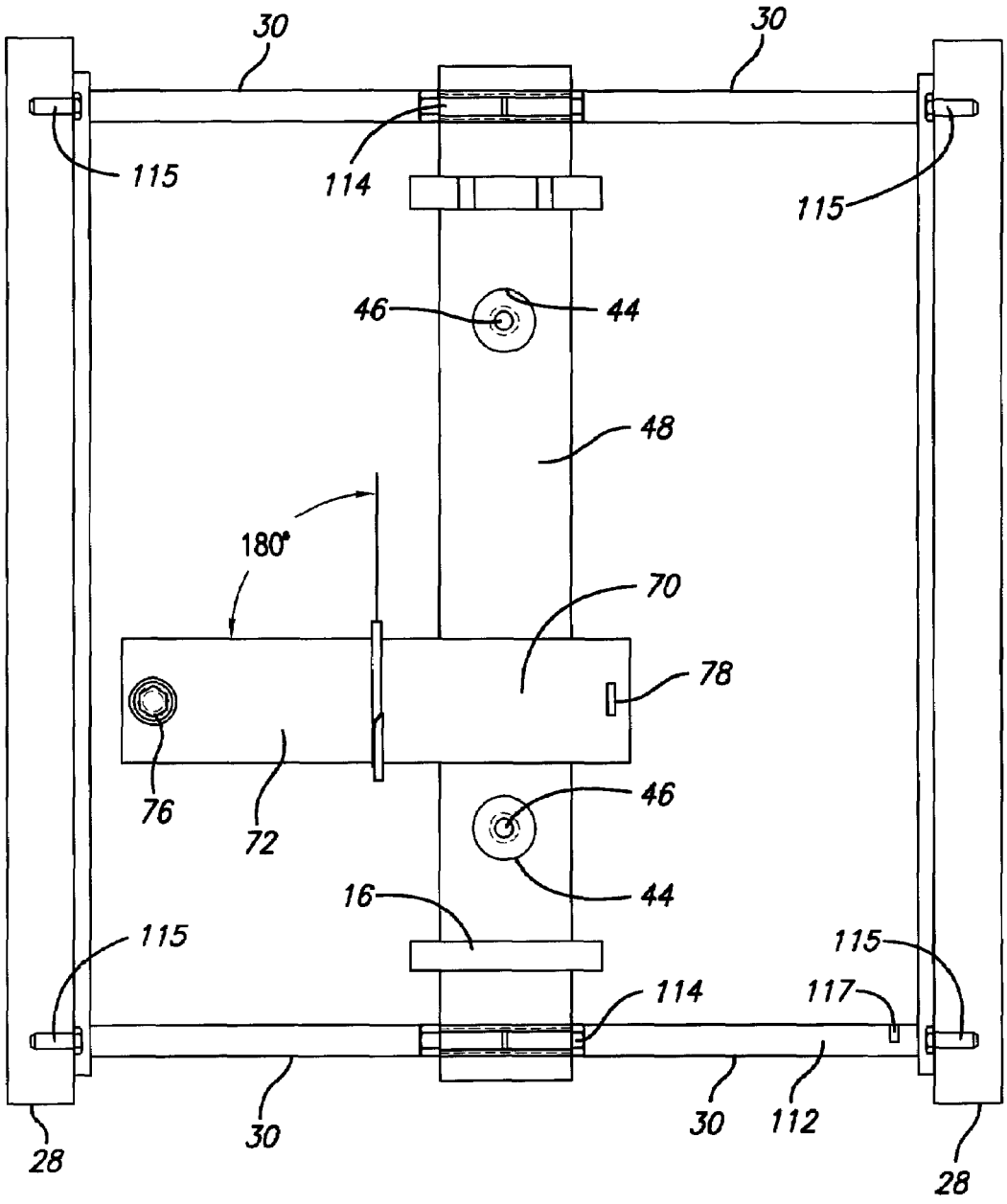
FIG. 7 is a front elevational view of an alternate embodiment of the firearm wall lock.

The post 14 of the firearm wall lock 10 is a vertical member that mounts to a wall stud 28 or between two studs 28. In one embodiment, the post 14 can be manufactured from steel square tubing. The post 14 has a face 42 that includes two apertures 44 to provide access to two inner apertures 46 as shown in FIG. 7. The apertures 46 permit attachment of the post 14 to the wall 26. The post 14 also includes sides 48 that have five slotted holes 50. The upper and lower holes 50 are used for the side mounting brackets 30 in lieu of the face mounts. The three central holes 50 form component attachment slots that are used to mount the shelf 16, locking clasp assembly 18, and clamp 20 to the post 14. The attachment slots 52 are slotted to allow for vertical adjustment of the shelf 16, the locking clasp assembly 18 and the clamp 20 to permit the mounting of various size firearms 12. While the firearm wall lock 10 is shown attached in a vertical position, the firearm wall lock 10 can also be installed in a horizontal position.

In the illustrated embodiment, the shelf 16 is formed from a flat piece of steel with padding 54 along the top, or superior surface. The shelf 16 attaches perpendicular to the post 14 via a shelf bracket 56. The butt 58 of the firearm 12 rests on the shelf 16. The shelf 16 is adjustable vertically to allow for variable distance between the butt 58 of the firearm and the trigger/breach area 60.

Figure 2:
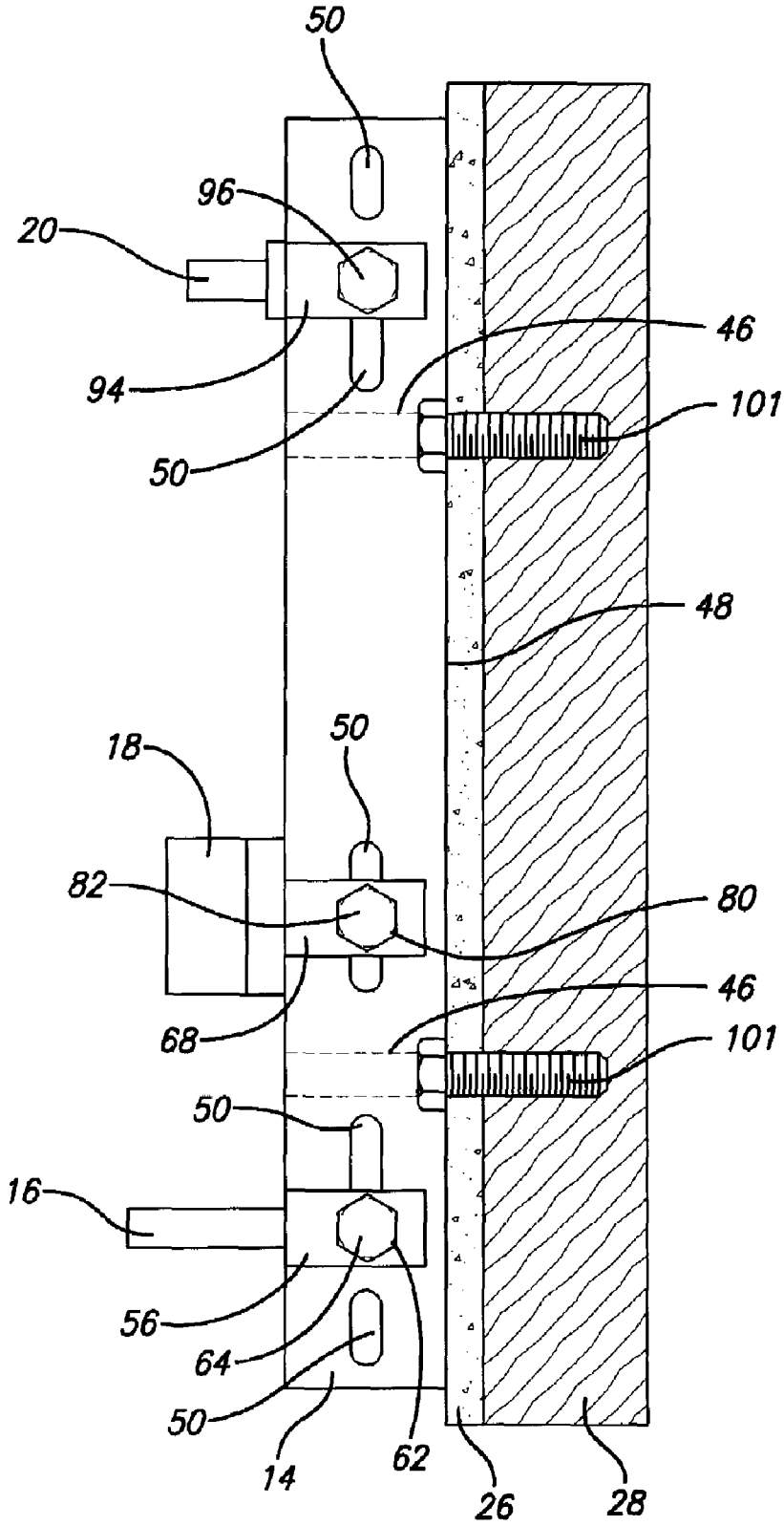
FIG. 2 is a side elevational view of the firearm wall lock.
Figure 3:
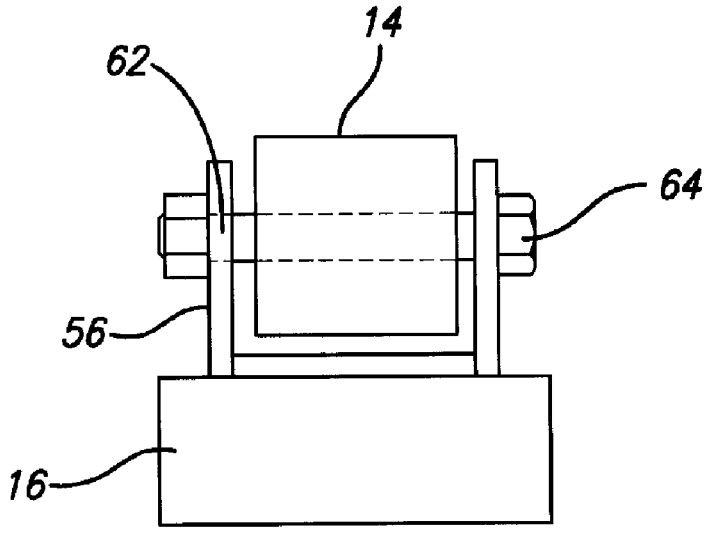
FIG. 3 is top view of the firearm wall lock illustrating the shelf assembly.
Figure 4:
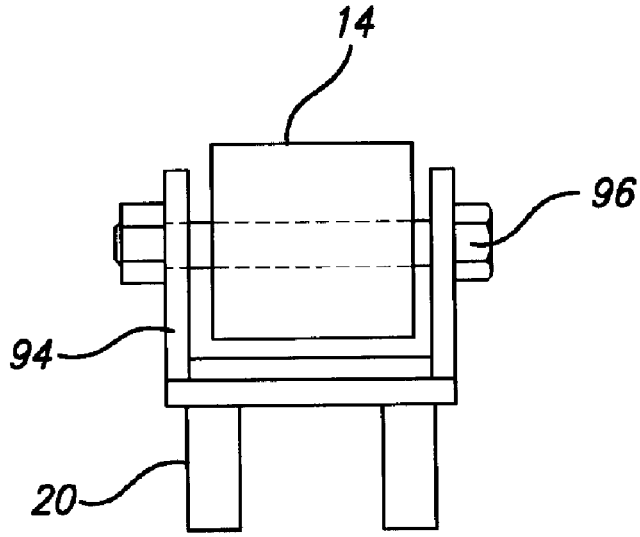
FIG. 4 is a top view of the firearm wall lock illustrating the clamp assembly.

The shelf bracket 56 is formed from a U-shaped piece of steel that fits around the post 14, as shown in FIG. 2. The shelf 16 is attached to the face of the shelf bracket 56. The shelf bracket 56 includes two apertures 62 that allow a mounting bolt 64 to pass through and secure the shelf bracket 56 to the post 14.

The locking clasp assembly 18 is an enclosure that envelops the majority of the trigger, breach, and hammer portion of the firearm 12 as possible. The locking clasp assembly 18 attaches to the post 14 via a locking clasp bracket 68. The locking clasp assembly 18 includes a locking clasp back 70, a locking clasp front 72, a hinge 74, a lock 76, locking clasp pin 85 and the lock receiver 78 as shown in FIG. 1.

The locking clasp back 70 is comprised of a large flat piece of metal that attaches to the locking clasp bracket 68. At one end of the locking clasp back 70 is the hinge 74, and at the opposing end is the lock receiver 78. A soft material to prevent marring the firearm covers the front of the locking clasp back 70 such as cloth, rubber or foam.

Figure 5:
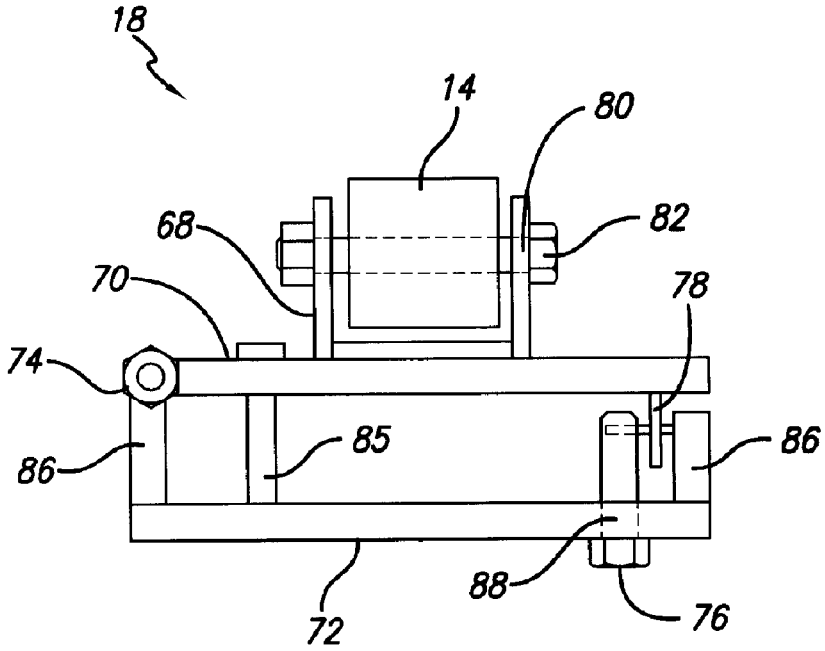
FIG. 5 is a top view of the firearm wall lock illustrating the locking clasp assembly in the locked position.
Figure 6:
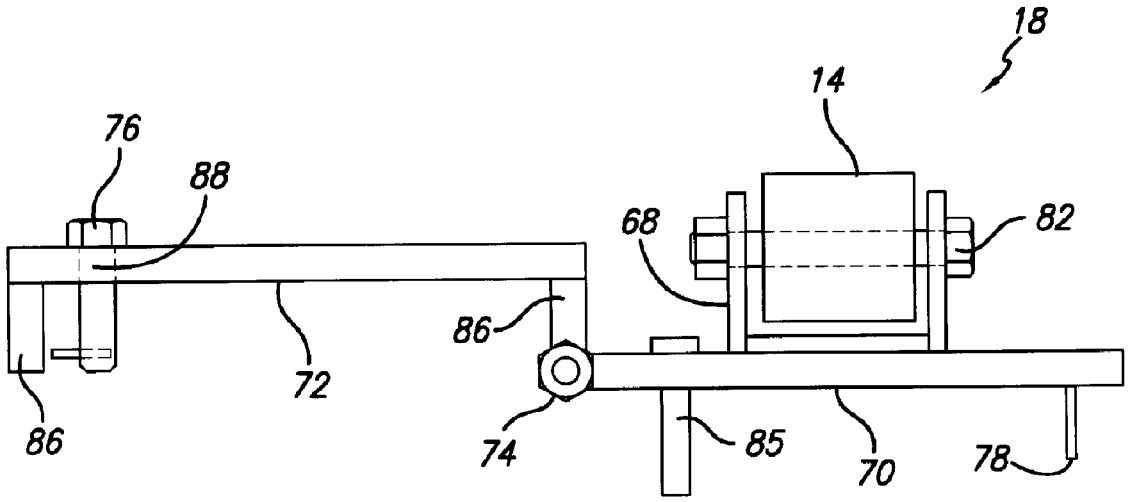
FIG. 6 is a top view of the firearm wall lock illustrating the locking clasp assembly in the unlocked position.

As shown in FIG. 5 and FIG. 6, the locking clasp pin 85 is a short, thick piece of steel attached to the locking clasp back 70. The locking clasp pin 85 prevents the firearm from being removed while the locking clasp assembly 18 is closed. The locking clasp pin 85 is mounted high on the locking clasp back 70 and is adjustable to the left and right to accommodate the varying thickness of firearms installed.

The locking clasp bracket 68 is comprised of a U-shaped piece of steel that fits around the post 14. The locking clasp assembly 18 is attached to the face of the locking clasp bracket 68. The locking clasp bracket 68 includes two apertures 80 that allow a mounting bolt 82 with a locknut 84 to pass through and secure the locking clasp bracket 68 to the post 14, as shown in FIG. 2.

The locking clasp front 72 is formed from a piece of metal curved to provide two end caps 86 and further includes an aperture 88 to receive the lock 76 and the lock receiver 78. When the locking clasp front 72 is pivoted on the hinge 74 to a closed position, the locking clasp assembly 18 forms a box that surrounds the trigger, breach and hammer of the firearm 12. The hinge-end 86 of the locking clasp front 72 has an outer shell of hard plastic with an interior of softer plastic or foam. These elements prevent the trigger from being activated while a firearm 12 is stored within the firearm wall lock 10 and prevent the firearm 12 from becoming marred during storage.

The hinge 74 is a sturdy, tamper resistant hinge that pivotally attaches the locking clasp back 70 to the locking clasp front 72. The hinge 74 permits the locking clasp front 72 to pivot 180 degrees to allow easy removal of the firearm 10 as shown in FIGS. 5 and 6.

A clasp lock 92 is incorporated to secure the locking clasp assembly 18 in a closed position. The clasp lock 92 incorporates a tamper resistant lock that will not release the key when the clasp lock 92 is in the unlocked position. The clasp lock 92 includes a tab that pivots with the rotation of the key. The tab engages the locking clasp lock receiver 78 when the locking clasp front 72 is in the closed position and the clasp lock 92 is in the locked position.

The locking clasp lock receiver 78 of the locking clasp assembly 18 is adapted to accept the metal tab of the lock 76 when the locking clasp front 72 is in the closed position and the lock 76 is in the locked position.

The clamp 20 is adapted to restrain the top of the barrel 24 of the firearm 12. The clamp 20 is adapted to hold the firearm vertically in place when the locking clasp assembly 18 is in the open position. The clamp 20 of the firearm wall lock 10 is padded in order to prevent marring the firearm barrel 24. The clamp 20 is adjustable vertically, or along the length of the post, to allow for variable height (length) of the firearm 12. The clamp 20 is adjustable horizontally to accommodate various diameter firearm barrels 24. The clamp 20 attaches to the post 14 via a clamp bracket 94.

The clamp bracket 94 of the firearm wall lock 10 is a U-shaped member fabricated from steel that is adapted to fit around the post 14. The clamp 20 is attached to the face of the clamp bracket 94. The clamp bracket 94 includes two apertures that permit the attachment of a mounting bolt 96. The mounting bolt 96 secures the clamp bracket 94 to the post 14.

The post 14 utilizes surface mounting holes 46 that are located in the back of the post 14 used to mount the post 14 to a wall stud. The post 14 further includes the front surface mounting holes 44 that are large enough to allow the head of a lag bolt 101 to pass through. The lag bolt 101 is a self-tapping bolt with a secure head that requires a special tool to install. The lag bolt 101 is used to secure the post 14 to a wall stud 28 or secure the mounting brackets 30 to the wall studs. The rear surface mounting holes 46 are only large enough to allow the shaft of the lag bolt 101 to pass through. The head of the lag bolt 101 binds against the area around the rear surface mounting holes 46.

The side mounting brackets 30, are formed from a piece of metal with both ends are bent at right angles. The side mounting brackets 30 further includes holes for mounting to the post 14 to the wall studs 28 as shown in FIG. 7. A set of the side mounting brackets 30 are used to install the firearm wall lock 10 in the recessed mounting position. The brackets 30 bolt to the side of the post 14 near the top and bottom using the mounting bolts 114. The brackets 110 attach to the wall stud using lag bolts 115. The firearm wall lock 10 also includes a side mounting bracket latch slot 112. The latch slot 112 is a modified side mounting bracket. The modification consists of the addition of a slot 117 in the bracket to act as a receiver for the cabinet lock 38. The firearm wall mount 10 may also include the front panel assembly 32, which is used in the recessed mounting position. The front panel assembly 32 is a large piece of metal that covers the area removed from the wall when the firearm wall lock is recessed into the wall. The front panel assembly 32 includes a front panel 114 that is attached via a front panel hinge 34 to a front panel bracket 36 and has a cabinet lock 38 in the lower corner, as shown in FIG. 8. The front panel bracket 36 is adapted to be inserted between the side mounting brackets 110 and the wall stud 28 on one side of the firearm wall lock 10. The front panel bracket 36 attaches to the front panel hinge 34 and supports the front panel 114. The cabinet lock 38 is a small fastener that secures the front panel assembly 32 to the side mounting bracket with cabinet lock slot 117. When fastened, the cabinet lock 38 keeps the front panel assembly 32 closed.

The back panel 118 is adapted to be used with the recessed mounting arrangement. The back panel 118 is formed from metal and covers the area behind the post 14 for the recessed mounting of the firearm wall lock 10. The back panel 14 is attached to a back panel bracket 120. The back panel bracket 120 is comprised of a long section of metal that inserts between the side mounting brackets 30 and the wall stud 28 on one side of the firearm wall lock 10. The back panel bracket 120 attaches to the back panel 118.

After installation and firearm setup, a long barreled firearm 12 may be secured in the firearm wall lock 10. To secure the firearm 12 to the firearm wall lock 10 the locking clasp assembly 18 is unlocked and pivoted to an open position. When securing the firearm 12 in the firearm assembly 10 it is advisable for the user to ensure that the firearm does not have a round chambered and ensures that the safety is on. Next, the butt 58 of the firearm is positioned onto the shelf 16 and the barrel 24 is placed within the clamp 20. The shelf 16 and the clamp 20 maintain the firearm 12 in a stored, unsecured position.

To safely secure the firearm 12 after the firearm 12 is placed into the firearm wall lock 10 the user swings the locking clasp assembly 18 to a closed position so that the locking clasp assembly 18 covers the firing assembly and turning the key to the locked position. The firearm is now secured and cannot be activated or removed.

To remove a secured firearm 12 from the firearm wall lock 10, the user first inserts a key into the lock and turns the lock to an unlocked position. Once the lock is in the open position, the locking clasp assembly 18 is pivoted to an open position so that the locking clasp assembly is clear of the firearm 12. To remove the firearm 12 from the firearm wall lock 10 after the locking clasp assembly 18 has been unlocked, the user first inspects the firearm 12 to ensure that the safety is engaged. The user next pulls the firearm 12 away from the firearm wall lock 10 to removal from the clamp. Once the barrel 24 is free from the clamp 20 the butt 58 of the firearm 12 is removed from the shelf 16.

The firearm wall lock 10 can be installed in multiple ways. The figures illustrate two such arrangements. The first is on the outside of the wall 26 and the second is inside the wall 26. An outside wall installation consists of mounting the fire arm wall lock post 14 to a stud 28 in the wall 26 with two lag screws. Such installation requires the determination of the location of the stud 28 within the wall 26. Marking the wall with two points that correspond to the holed in the post 14. Next the user drills two holes in the wallboard and stud to permit securing of the lag screws. Once the holes are drilled the post 14 is aligned and the lag bolts are installed. As previously stated, the post can be oriented in a horizontal position perpendicularly oriented to the wall studs 28.

To install the fire arm wall lock 10 inside a wall 26 the user must first determine the location of the two studs 28 within the wall and remove the wall material between the studs. Next the back panel bracket 120 is inserted between the mounting brackets 110 and the wall stud 26. If the front panel assembly 32 is being installed the front panel bracket is installed between the mounting brackets and the wall stud. Next the mounting brackets are attached to the studs using lag bolts. The lag bolts are aligned with the side mounting holes of the post 14. Next the post 14 is attached to the mounting brackets using the mounting bolt with locknuts.

Various features of the disclosure have been shown and described in connection with the illustrated embodiment, however, it is understood that these arrangements merely illustrate, and that the disclosure is to be given its fullest interpretation.

What is claimed is:

1. A firearm wall lock for retaining a firearm comprising:

a post defining a face having a first aperture and a first inner aperture, a second aperture and a second inner aperture for receiving means for attaching the post to a wall, a side of the post having a plurality of slotted holes;

a padded clamp connected to the post and adapted to retain the barrel of the firearm;

a shelf vertically adjustably connected to and protruding from the post and adapted to support the butt of the firearm;

a locking clasp assembly connected to the post, the locking clasp assembly adapted to surround the breach and firing mechanism of the firearm; and the locking clasp assembly further including a lock that permits the locking clasp assembly to be locked in a closed position to prevent removal of the firearm from the firearm wall lock and to prevent access to the breach and firing mechanism of the firearm.

2. The firearm wall lock of claim 1, wherein the post comprises a side having at least five slotted holes, for receiving items selected from the group consisting of at least one side mounting bracket, the shelf, the locking clasp assembly, the clamp and combinations thereof.

3. The firearm wall lock of claim 1, wherein the shelf is vertically adjustable and perpendicularly attached to the post with a U-shaped shelf bracket having at least two apertures for receiving bolts to secure the shelf bracket to the post.

4. The firearm wall lock of claim 1, wherein the shelf further includes a padding on a superior surface.

5. The firearm wall lock of claim 1, wherein the clamp is adjustable along the length of the post to receive firearms of variable heights.

6. The firearm wall lock of claim 5, wherein the clamp is secured to a clamp bracket, the clamp bracket including at least one aperture for receiving bolts to secure the clamp to the post through at least one back surface mounting hole and at least one front surface mounting hole located on the post.

7. The firearm wall lock of claim 1, wherein the clamp is adjustable horizontally for receiving various diameters of firearms.

8. The firearm wall lock of claim 1, wherein the locking clasp assembly further includes a hinge at a first end of the locking clasp assembly to permit the assembly to be pivoted to an open position.

9. The firearm wall lock of claim 8, further comprising a locking clasp pin that is horizontally adjustable to accommodate varying sizes of firearms.

10. The firearm wall lock of claim 8, wherein the first end of the locking clasp assembly includes a soft material selected from the group consisting of rubber, foam, cloth and combinations thereof.

11. The firearm wall lock of claim 1, further comprising a main body adapted to be secured to the structure, a back panel and a front panel assembly of the main body, the front panel assembly adapted to conceal the firearm within the wall cavity in a recessed mounting position relative to the front panel.

12. A firearm wall lock for retaining a firearm comprising:

a post comprising a face including a first aperture and a first inner aperture, a second aperture and a second inner aperture for receiving means for attaching the post to a wall, a side of the post having at least five slotted holes;

a padded clamp connected to the post and adapted to retain the barrel of the firearm, wherein the clamp is secured to the post by a clamp bracket and is adjustable along a length of the post and is horizontally adjustable;

a padded shelf perpendicularly connected to the post by a shelf bracket and adapted to support the butt of the fire arm, wherein the shelf is vertically adjustable;

a locking clasp assembly connected to the post, the locking clasp assembly adapted to surround the breach and firing mechanism of the firearm; and the locking clasp assembly further including a lock that permits the locking clasp assembly to be locked in a closed position to prevent removal of the firearm from the firearm wall lock and to prevent access to the breach and firing mechanism of the firearm.

13. The firearm wall lock of claim 12, wherein the slotted holes receive items selected from the group consisting of at least one side mounting bracket, the shelf, the locking clasp assembly, the clamp and combinations thereof.

14. The firearm wall lock of claim 12, wherein the locking clasp assembly further comprises a locking clasp front and a locking clasp back, the locking clasp back comprised of a flat piece of metal, having a hinge at a first end of the locking clasp back and a lock receiver at a second end of the locking clasp back, wherein the locking clasp back is secured to a locking clasp bracket, the locking clasp front comprised of a curved metal comprising at least one aperture for receiving the lock and the lock receiver, wherein the lock receiver receives a metal tab of the lock when the locking clasp front is closed and the lock is engaged, wherein a hinge pivotally attaches the locking clasp back to the locking clasp front, wherein the pivot is provided up to 180° between an open and a closed position of the locking clasp front.

15. The firearm wall lock of claim 14, further comprising a locking clasp pin superiorly mounted on the locking clasp back and is horizontally adjustable to accommodate varying sizes of firearms.

16. A firearm securing device for securing a firearm to a structure to prevent an accidental or unauthorized discharge of the firearm, the firearm securing device comprising:

a main body adapted to be secured to the structure;

a post of the main body defining a face having a first aperture and a first inner aperture, a second aperture and a second inner aperture for receiving means for attaching the post to a wall, a side of the post having a plurality of slotted holes;

a barrel support member connected to the main body and adapted to support the barrel of the firearm;

a padded clamp connected to the post and adapted to retain the barrel of the firearm;

a firearm stock support connected to the main body and adapted to support the stock of the firearm;

a shelf vertically adjustably connected to and protruding from the post and adapted to support the butt of the firearm;

a locking clasp assembly including a lock connected to the main body and adapted to surround the breach and firing mechanism of the firearm when in a secured position to prevent the accidental or unauthorized access to the breach or firing mechanism of the firearm;

wherein the firearm cannot be removed from the firearm securing device when the locking clasp assembly is in the secured position.

17. The firearm securing device of claim 16, wherein the barrel support member is adjustable to accommodate firearms of varying length.

18. The firearm securing device of claim 17, wherein the barrel support member is adapted to releasably secure the barrel of the firearm.

19. The firearm securing device of claim 16, wherein the firearm stock support is adjustable to accommodate firearms of varying length.

20. The firearm securing device of claim 16, wherein the barrel support member, stock support member and locking clasp assembly are padded to prevent damage to the firearm.

21. The firearm securing device of claim 16, wherein the main body is recessed within the structure.

22. The firearm securing device of claim 21, wherein the firearm securing device further includes an access panel to conceal the firearm within the structure.

23. The firearm securing device of claim 16, wherein the locking clasp assembly includes a hinge adapted to permit the locking clasp assembly to pivot from an open position to a secured position.

24. The firearm securing device of claim 16, wherein the locking clasp assembly includes a lock to retain the locking clasp assembly in the secured position.

* * * * *